United States Patent [19]

Nöhren et al.

[11] Patent Number: 5,016,534

[45] Date of Patent: May 21, 1991

[54] MISSILE FOR SETTING DOWN A LOAD

[75] Inventors: Hubert Nöhren, Hamburg; Gerhard Siebrand, Quickborn; Werner Moritzen, Elmshorn, all of Fed. Rep. of Germany

[73] Assignee: Autoflug GmbH & Co., Rellingen, Fed. Rep. of Germany

[21] Appl. No.: 391,452

[22] Filed: Aug. 9, 1989

[30] Foreign Application Priority Data

Aug. 10, 1988 [DE] Fed. Rep. of Germany ..... 3827123

[51] Int. Cl.[5] ..... B64D 17/54; F42B 10/56

[52] U.S. Cl. ..... 102/387; 102/489; 244/151 A

[58] Field of Search ..... 244/137.3, 151 A; 102/387, 489, 393, 348, 306, 476

[56] References Cited

U.S. PATENT DOCUMENTS

| | | | |
|---|---|---|---|
| 2,723,876 | 11/1955 | Langlois et al. | 102/387 |
| 3,066,632 | 12/1962 | Bemis | 102/387 |
| 3,107,370 | 10/1963 | Gaylord | 244/151 A |
| 3,713,387 | 1/1973 | Karp | 102/387 |
| 3,715,668 | 2/1973 | Herring et al. | 102/387 |
| 3,817,179 | 6/1974 | Ludtke et al. | 102/387 |
| 4,050,381 | 9/1977 | Heinemann | 102/387 |
| 4,372,215 | 2/1983 | Crepin | 102/387 |
| 4,538,519 | 9/1985 | Witt et al. | 102/387 |
| 4,711,178 | 12/1987 | Argyrakis | 102/387 |
| 4,805,582 | 2/1989 | Synofzik et al. | 102/387 |

FOREIGN PATENT DOCUMENTS 3510990 10/1986 Fed. Rep. of Germany .

*Primary Examiner*—David H. Brown

*Attorney, Agent, or Firm*—Robert W. Becker & Associates

[57] ABSTRACT

In a missile for setting down a load ejected from the missile after its launch, with at least one parachute that is attached to the load being packed in a container mounted in the missile, and with the cords of the load-carrying parachute being attached to an intermediate member coupled to the load, the intention is to reduce the size of the operational parts to be transported with the missile and improve the operation thereof during the setting down process. For this purpose it is envisaged that the container should be in the form of a two-part casing having an upper part which can be sprung open, and a plate-shaped lower part having a portion fixedly connected to the load and a support disk as the intermediate member attached to cords of the parachute. The support disk is capable of being folded out from the lower part portion while remaining connected thereto by a connecting element.

21 Claims, 4 Drawing Sheets

FIG-6
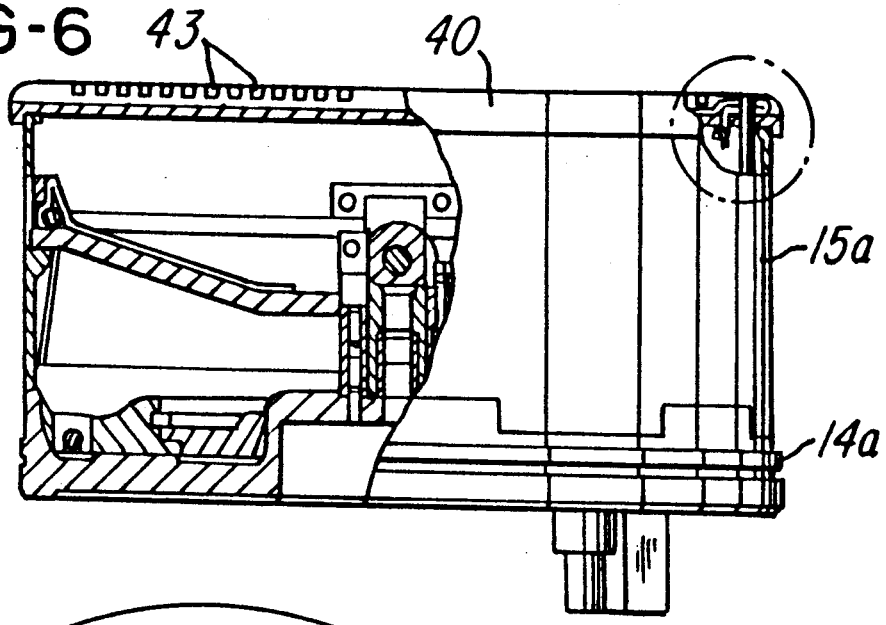
FIG-7
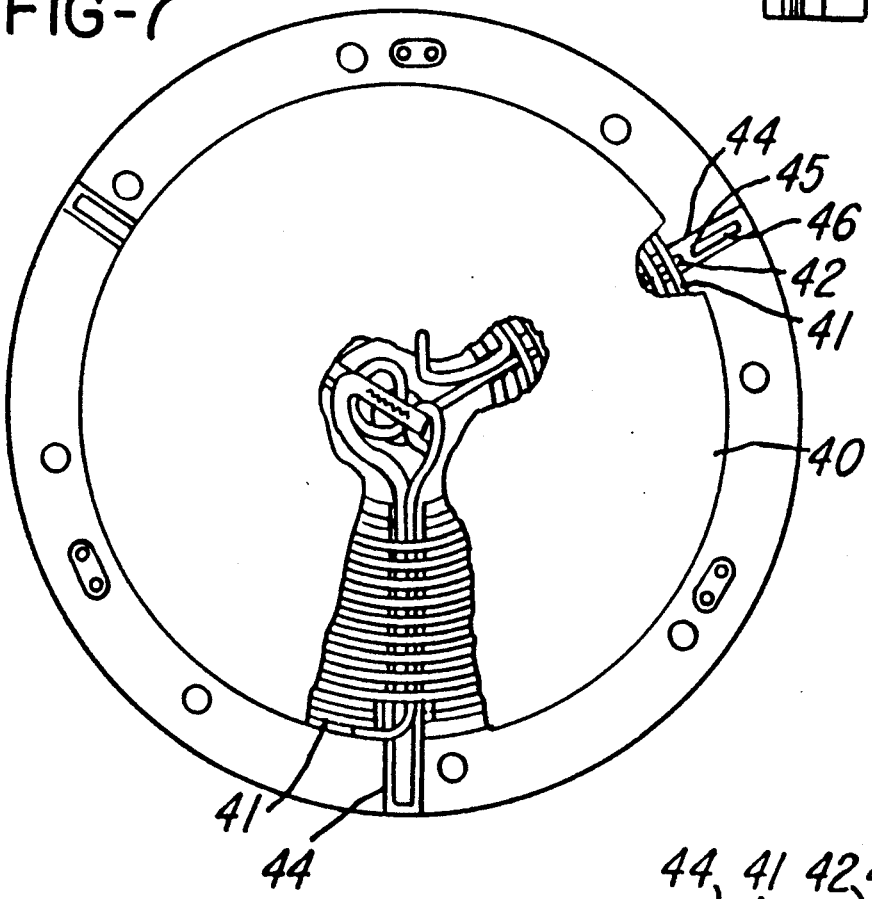
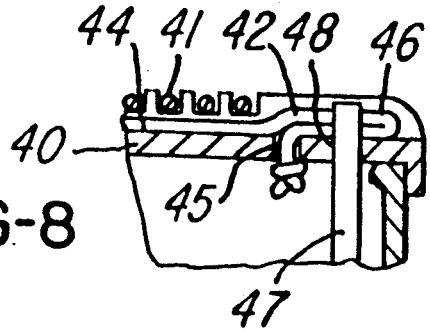
FIG-8

MISSILE FOR SETTING DOWN A LOAD

BACKGROUND OF THE INVENTION

The present invention relates to a missile for setting down a load ejected from the missile after its launch, with at least one parachute that is attached to the load being packed in a container mounted in the missile.

A missile of this type is described in DE-OS 35 10 990; in the missile there is an intermediate container which receives both the load which is to be set down and also the parachute attached thereto. After the intermediate container has been separated from the missile, the intermediate container releases both parts, so that the parachute can open and allow the load to drop. The lines of the parachute are coupled not to the load itself but to the intermediate container coupled to the load, forming part of a freewheeling device which allows the load to rotate relative to the parachute.

This arrangement has the disadvantage that the unit to be set down is of substantial depth in the axial direction of the missile, which presents problems particularly when a plurality of loads are to be set down by means of one missile. One aim of the invention is therefore to provide a missile in which the depth of the unit to be set down is reduced and at the same time reliable deployment of the parachute is enabled.

From DE-OS 33 41 990, a retaining disk is also known as the fixing for the cords of the load-carrying parachute, from which the load is suspended by means of a non-rotational but flexible connecting member; the rotation of the parachute with the retaining disk should also be capable of being transmitted to the load; however, this measure has no effect on the overall height of the unit comprising the load and parachute.

SUMMARY OF THE INVENTION

The inventive missile for setting down a load ejected from the missile after its launch is characterized primarily by packing at least one parachute for supporting the load in a container mounted in the missile, wherein the container is in the form of a two-part casing having an upper part separable from a substantially plate-shaped lower part, the lower part having a portion fixedly secured to the load and a support plate attached to cords of the parachute, the lower part portion and the support plate being arranged to be folded out from each other while remaining connected together.

With such an arrangement, because the portion of the lower part of the casing which is fixed to the load, and the support plate, can be folded out from each other, the unit comprising the load and the parachute packed in the casing, which unit has to be accommodated in the missile, can be kept very short in construction.

Preferably the lower part portion and the support plate are connected by a connecting element which can be folded out to a position between the lower part portion and the support plate. The connecting element may be constructed as a flexible shaft or as a rigid swing arm.

The lower part portion and the support plate may possibly be secured in their resting position by means of a suitably mounted securing member with a frangible point.

In one embodiment of the invention, the load is secured to the connecting element centrally, and in another embodiment it is secured with an eccentricity. In the latter case the load automatically assumes an inclined position, depending on the position of its center of gravity, in relation to the point of attachment to the connecting element, while measures are taken to ensure that the support plate (which may be in the form of a disk) is always at right angles to the central axis of the parachute.

Another embodiment of the invention is based on the premise that a rotary parachute is used as the load-carrying parachute and at the same time the missile is set rotating at high speed as a result of its launch, as described in DE-OS 35 10 990. There is the problem of adapting the different speeds of rotation of the parachute on the one hand and the load on the other hand to each other at the moment of development of the parachute, to prevent the cords of the parachute from being twisted, but at the same time obtaining controlled rotation of both the parachute and the load as they fall to earth. In the known apparatus, a freewheeling mechanism is provided which does not transmit the higher speed of rotation of the load relative to the newly opened parachute to said parachute, but which is locked after the speeds of rotation have been adapted to each other, so that the rotation proceeding from the parachute is transferred to the load as they fall to earth.

This has the disadvantage that the freewheeling mechanism operates only in one direction; furthermore, special rotary brakes are provided on the load in order to decelerate the load to the speed of rotation of the parachute, which is substantially less after deployment, and finally the time taken for the deceleration of the rotation of the load and the mechanical complexity involved in blocking the freewheeling connection are considerable. Finally, it is not impossible that when the missile is launched, the high rotational acceleration of the missile will cause the mechanical parts of the connection to slip, thus jeopardizing reliable operation of the system.

A further object of the invention is therefore to design a system for the use of a rotary parachute as the load-carrying parachute in a missile subjected to torque so that, while the overall length is still short, the speeds of rotation of the load and parachute can rapidly be adapted to each other, and reliable operation of the coupling is ensured. For this purpose, the support plate or disk is constructed as a sliding coupling with an outer coupling ring as the fixing for the cords of the rotary parachute, and an inner rotary plate as the carrier of the load. This advantageously ensures that, as the high initial force is exerted with the parachute deployed, a high torque can be transmitted through the sliding coupling, so that the speeds of the parachute on the one hand and the load on the other hand can be adapted to each other more rapidly. For this purpose, the sliding coupling has, according to a preferred embodiment of the invention, a sliding moment which is less than the torque of the rotary parachute under all load conditions.

According to a preferred embodiment of the invention, the outer coupling ring of the sliding coupling, which is folded into the lower part of the casing in its resting position, is secured by means of at least one retaining lug mounted on the upper part of the casing and engaging in a corresponding recess in the coupling ring, in such a way that the coupling is secured both axially and against any rotational acceleration displacing the parts, even at the high initial acceleration of the missile; consequently, any slipping of the parts of the coupling caused by the forces of inertia is ruled out.

The subdivision of the support plate or disk into a two-part coupling means that, according to another improved embodiment of the invention, in addition to the cords engaging on the coupling ring there is a central line extending from the apex of the rotary parachute to the coupling ring of the coupling, said central line being first to receive the load when the parachute is extended; in order to prevent the coupling with the load suspended from it swinging back and forth around the central line when the latter initially takes all the weight, this central line is divided up, above the rotary plate, into three centering lines which are symmetrically attached to the coupling ring.

It is particularly advantageous to use the invention within the scope of a two-stage parachute system known per se, in which, once the missile has been separated off, a drag parachute is initially deployed. Advantageously thanks to the short design of the components described hereinbefore, it is possible to pack the drag parachute, which is attached to a shell by means of a release cord, in the upper part of the casing, the cords of the drag parachute being attached to the casing. The separation of the parts of the casing as the upper part springs off is effected in this case by means of a timer mounted in the casing which causes the parts to separate after a given time so that the load-carrying parachute packed in the casing together with the arrangement of the load suspended therefrom, as described above, can open up.

One measure for securing the drag parachute in the upper part of the casing to prevent damage or separation of the activating cord as a result of the bursting open of the bottom of the missile caused by aerodynamic or mechanical failure is based on the premise of sealing the upper part of the casing by means of a releasable cover, this cover being attached on the one hand to the drag parachute by means of a release cord and on the other hand to the bottom of the missile by means of an activating cord. The cover has special features in the form of grooves for receiving the activating cord.

An advantageous embodiment by way of example is characterized in that the activating cord divides up, above the cover, into three centering lines of equal length, the activating cord being placed in a spiral groove formed in the surface of the cover, where it is held in place by means of a plastic mass, while the centering lines are placed in radial grooves extending under the plane of the spiral groove and are secured by their ends to the cover.

According to an advantageous embodiment of the invention, the centering lines simultaneously serve to form the releasable connection between the cover and the upper part of the casing, in that loops passed through the cover from the upper part of the casing have the centering line, which is also looped, passing through them.

This arrangement has major advantages which consist in the protection of the activating cord and the adjoining centering lines from mechanical damage. The cover releasably mounted on the casing confers protection for the drag parachute packed therein, while the use of three centering lines as the closure for the cover as well constitutes a particular advantage, particularly as the design of the cover ensures that the lines are well mounted to protect them from acceleration in the axial or radial direction. By embedding the activating cord in a cast mass in the spiral groove, the straightening force of the activating cord is maintained at a constant level, and similarly, because of the fact that the centering lines are all the same length, the cover is simultaneously released from the upper part of the casing.

Advantageously, the invention can also be applied to one-stage parachute systems and also to those with a rotary parachute as the load-carrying parachute and also to two-stage parachute systems having a drag parachute and a load-carrying parachute of whatever construction.

BRIEF DESCRIPTION OF THE DRAWINGS

Certain preferred embodiments of the invention will now be described by way o±example and with reference to the accompanying drawings; these embodiments have a two-stage parachute system, using a rotary parachute as the load-carrying parachute. In the drawings:

FIG. 6 shows a view similar to FIG. 2 of another embodiment of the casing;

FIG. 7 is a plan view of the casing cover; and

FIG. 8 is an enlarged view of the fixing of the cover to the casing.

DESCRIPTION OF PREFERRED EMBODIMENTS

Figure 2:
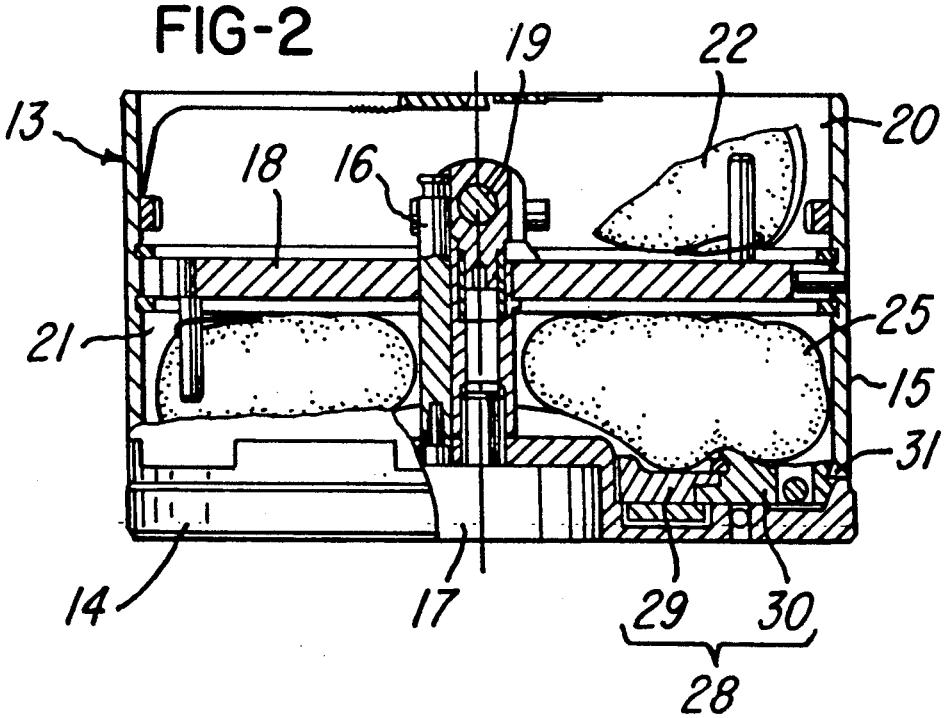
FIG. 2 shows an enlarged view of the parachute casing.

In a missile 10 having a base 11 which is removable to release it contents, there is mounted a load 12 and a two-part casing 13 that comprises a lower part 14 and an upper part 15. Although not shown in detail, the casing 13 has on its circumference a claw-shaped contour for reliably transmitting rotational acceleration from the missile of the casing. As can be seen in detail in FIG. 2, the lower part 14 and upper part 15 of the casing are joined together by means of a bolt 19 which in turn is releasable by a timer 17 arranged in the lower part 14 of the casing and with unlocking pin 16. The upper part 15 of the casing also has an intermediate partition 18 by means of which the casing 13 is subdivided into an upper packing chamber 20 and a lower packing chamber 21. The connecting bolt 19, from which the casing 13 as a whole can be suspended, also engages on this intermediate partition 18.

Figure 1:
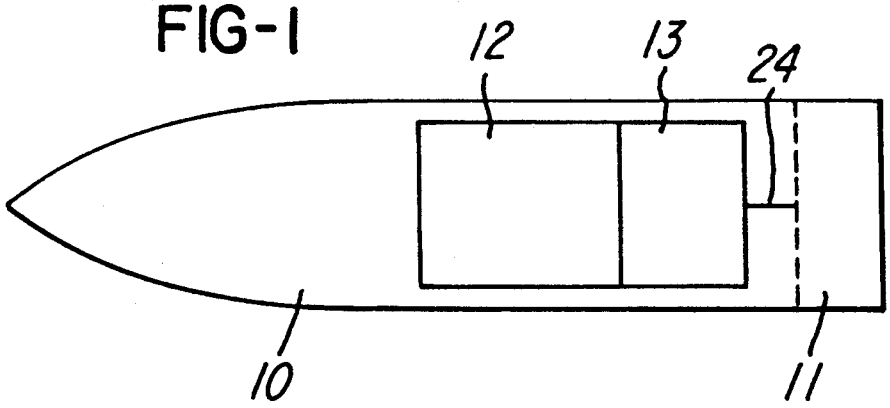
FIG. 1 shows a diagrammatic view of the missile with the load and casing.

Packed in the upper chamber 20 is a drag parachute 22, which may be in the form of a ribbon break parachute, and which has a carrying harness 23 (FIG. 3) that is secured to the connecting bolt 19 of the casing 13. The drag parachute 22 is connected to the base 11 of the missile 10 by means of a release cord 24 (FIG. 1).

A rotary parachute 25 is packed in the lower packing chamber 21, to serve as the load-carrying parachute.

The lower part 14 of the casing, which is fixedly connected to the load 12, for example by a tongue-and-groove configuration (FIG. 3), has folded onto the lower part 14 a support plate or disk 28 which is designed as a sliding slip, or rotary coupling with an inner rotary plate 29 and an outer coupling ring 30; the outer coupling ring 30 is secured against both axial displacement and against rotation caused by the rotational acceleration occurring and exceeding the inertia of the coupling, by means of retaining lugs 31 formed on the lower edge of the upper part 15 of the casing, while the casing 13 is closed. Otherwise, the sliding coupling 29, 30 operates on the principle well known to those skilled in the art and is constructed accordingly in its individual parts.

Figure 3:
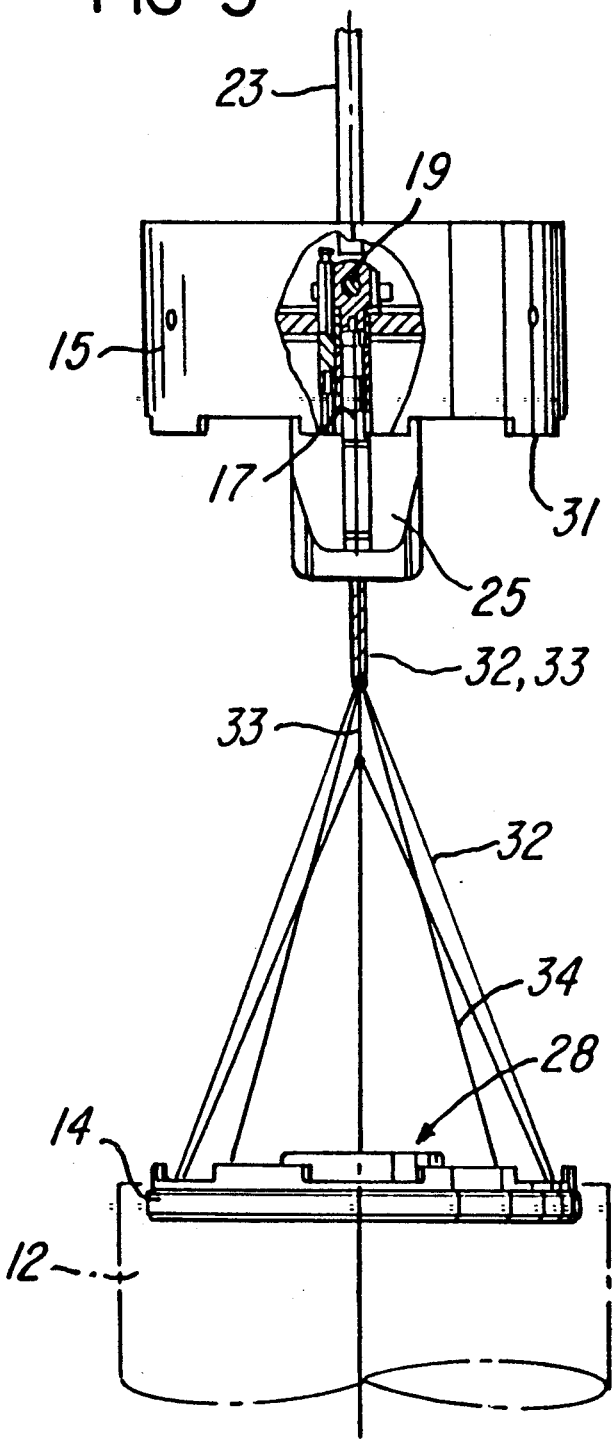
FIG. 3 shows the casing with the upper and lower parts of the casing separated.

FIG. 3 shows the casing at the moment when the upper part 15 thereof has separated from the lower part 14 and the rotary parachute 25 shown still in the packaged state is beginning to open out. This shows that the cords 32 of the rotary parachute 25 are attached to the coupling ring 30, while a central line 33 also extends to the coupling ring 30, but is divided into three centering lines 34 symmetrically attached to the coupling ring 30. This ensures that the support disk 28 with the sliding coupling 29, 30 is always aligned at right angles to the central axis of the parachute. This method of suspension of the sliding coupling ensures that the cords 32 of the rotary parachute 25 which are engaging under an unstable equilibrium do not cause the sliding coupling 29, 30 to tilt and consequently produce undesirable instability. The cords 32 are pre-twisted about the central line 33 with a number of rotations, preferably three, counter to the subsequent direction of rotation of the parachute 25.

Figure 4:
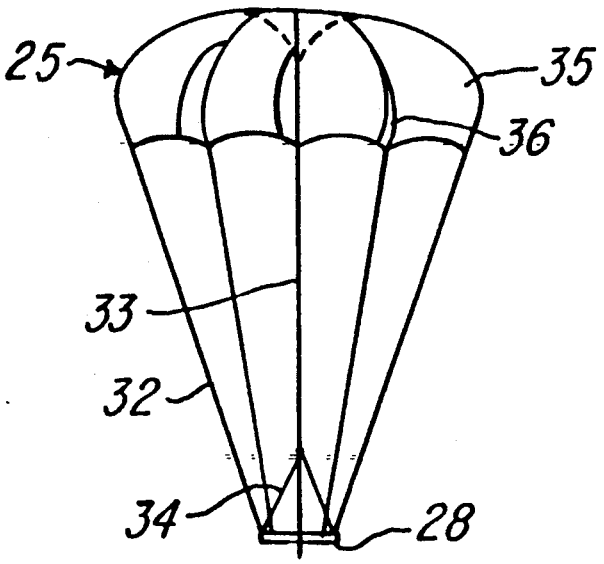
FIG. 4 shows a diagrammatic view of the rotary parachute as the load-carrying parachute.

FIG. 4 shows the deployed rotary parachute 25 diagrammatically with no load suspended; the canopy 35 of the parachute 25 has openings 36 to set the parachute rotating in a predetermined manner as its falls to earth; the cords 32, 33 of the parachute 25 in this representation end at the support disk 28 with the sliding coupling 29, 30.

Figure 5:
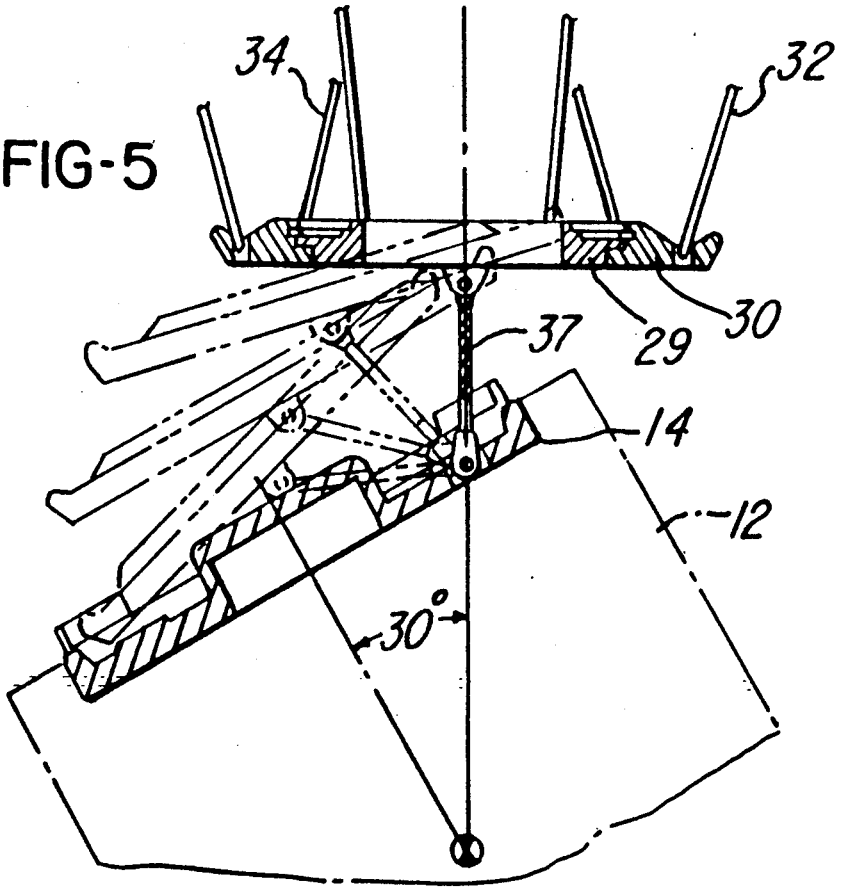
FIG. 5 shows an enlarged view of the suspension of the load.

FIG. 5 shows the suspension of the load 12 from the support disk 28 with the sliding coupling 29, 30. First of all, the lower part 14 of the casing is fixedly connected to the load 12; the lower part 14 of the casing is in turn connected to the support disk 28 by means of a folding arm or lever 37 centrally attached to the rotary plate 29, said arm in turn being eccentrically fixed to the lower part 14 of the casing, relative to the central axis thereof, so that the load 12 assumes an inclined position at an angle of 30° to the retaining disk, which is horizontally aligned with respect to the parachute 25. The drawing also shows the process of the unfolding of the support disk 28 via the folding arm or lever 37 from the lower part 14 of the casing.

On being launched, the missile 10 is set rotating at high speed to stabilize its flight; the operational parts 12, 13 mounted inside the missile are however secured against this applied rotational acceleration in the manner described. From the expulsion of the load 12 from the missile 10 to the fall to earth of the load 12 suspended from the rotary parachute 25, the following events take place.

When the missile 10 reaches the dropping position, the base 11 of the missile is released, as a result of which this base 11 activates the release cord 24 to pull first of all the drag parachute 22 out of the upper part 15 of the casing 13 and cause it to open out; because the carrying harness 23 of the drag parachute 22 is connected to the connecting bolt 19 of the casing 13, the initially closed casing 13 and the load 12 fixedly attached thereto via the lower part 14 of the casing are suspended from the drag parachute 22.

As the drag parachute 22 opens out, the unlocking pin 16 is pulled out of the timer 17 and the timer 17 is thus activated. After a predetermined time, the timer 17 releases the unlocking bolt 19 and the upper part 15 of the casing is separated from the lower part 14 (FIG. 3) and lags behind it. As a result, first of all the cords 32, 33 of the load-carrying parachute 25 are extended (FIG. 3), before the rotary parachute 25 is opened out immediately after.

The ejection of the upper part 15 of the casing also causes the securing lugs 31 to move out of engagement with the outer coupling ring 30 of the retaining disk 28, so that the sliding coupling 29, 30 can now come into operation. After the second parachute system has opened up, the lower part 14 of the casing and the support disk 28 are folded open, so that the load 12 with the lower part 14 of the casing is suspended via the folding arm 37 from the inner rotary plate 29 of the support disk 28, as shown in FIG. 5.

The different speeds of rotation of the opened parachute 25 on the one hand and the load 12 on the other hand, which occur after the rotary parachute 25 has opened out, are equalized by the action of the sliding coupling 29, 30. For this purpose, the sliding moment of the sliding coupling 29, 30 has a value which is less than the torque of the rotary parachute effective at any time, so that the speeds are rapidly brought into conformity with each other depending on the forces prevailing. If high force occur in the system, particularly at the beginning while the parachute is opening out and when there is a correspondingly great difference in rotation, a high torque will also be transmitted through the sliding coupling 29, 30, so that the speeds are rapidly evened out. As a result, the sliding coupling 29, 30 then brings about uniform transmission of the rotation from the rotary parachute 25 to the load 12 suspended therefrom, while the folding arm 37, in particular, advantageously ensures transmission of torque without any losses.

Although not shown in detail, the folding movement of the folding arm 37 as the connecting member between the parachute suspension means and the load may also be used to initiate other procedures relating to the use of the load, particularly inside the load.

FIGS. 6 to 8 show a particularly advantageous embodiment of the invention which is directed to the closure of the casing 14A, 15A and to the reliable release connection between the base of the missile and the casing. Thus, when the base 11 of the missile is separated, it must be impossible for the activating cord attached to the drag parachute 22 packed in the upper part 15A of the casing to be affected by any aerodynamic or mechanical disruption, or for its function to be impaired in any other way.

To solve this problem the upper part 15A of the casing is closed off by means of a cover 40 which is in turn attached to the drag parachute 22 in a manner not shown here. An activating cord 41 leads from the cover 40 to the base 11 of the missile 10; this cord 41 is divided, above the cover 40, into three centering lines 42 of equal length, which are in turn fixedly connected to the cover 40.

On its upper surface the cover 40 initially has a groove 43 extending spirally about its center, the activating cord 41 being placed in said groove in such a way that it coils u from the center outwards. In the groove 43 the activating cord 41 is cast with plastics to prevent it from being pulled off. Additionally, in the cover 40 there are three radial grooves 44 extending in a star configuration or pattern towards the center and running deeper than the spiral groove 43. The three centering lines 42 are placed in these grooves 44 and are attached by their ends each one in a hole 45 provided on the outer periphery of the cover 40.

The centering lines 42 also serve simultaneously to secure the cover 40 to the upper part 15 of the casing, by being looped in front of the point of attachment 45 thereof, the corresponding loop 46 passing through a closure eyelet 47 which is in turn attached to the upper part 15 of the casing and is passed up through an opening 48 in the cover 40.

In operation, the base of the shell pulls on the activating cord 41 located in the spiral groove 43 and because said cord 41 i s embedded in a cast plastics mass it uncoils from the center outwards with a constant uncoiling force. After being pulled out of the outer part of the spiral groove the activating cord 41 is distributed over three centering lines of equal length which are now pulled out of the radially extending grooves 44. Before the centering lines are pulled taut, they are released with their loops 46 from the closure eyelets 47, so that the cover 40 is released from the upper part 15 of the casing at the same time in the precise form. The way is now open for the drag parachute 22 to open up and initiate the further operations as described.

The invention is not restricted to the two-stage parachute system described above with a rotary parachute as the load-carrying parachute, but may be extended to the construction of a one-stage system and to all kinds of load-carrying drag parachutes.

The present invention is, of course, in no way restricted to the specific disclosure of the specification and drawings, but also encompasses any modifications within the scope of the appended claims.

What is claimed is:

1. In a missile for setting down a load ejected from the missile after its launch, with at least one parachute that is attached to said load via cords being packed in a container mounted in said missile, the improvement wherein:

said container is a two-part casing, including a substantially plate-shaped lower part to which an upper part is separably connected, with said lower part of said casing having a portion that is fixedly secured to said load and also having a support plate that is attached to said cords of said parachute, with means being provided to interconnect said portion of said lower part and said support plate thereof yet permit the same to be folded out from one another.

2. A missile according to claim 1, in which said means for interconnecting said lower part portion and said support plate is a connecting element that can be folded out to a position between said lower part portion and said support plate.

3. A missile according to claim 2, in which said connecting element is centrally attached to said lower part portion and to said support plate.

4. A missile according to claim 2, in which said connecting element is centrally attached to said support plate but is eccentrically attached to said lower part portion, so that depending on the eccentricity, said load assumes a defined inclined position relative to said support plate.

5. A missile according to claim 2, in which said connecting element is constructed as a swing arm.

6. A missile according to claim 2, in which said connecting element is in the form of a flexible shaft.

7. A missile according to claim 1, in which said support plate is secured in its resting position to said lower part portion by means of a securing member that has a frangible point.

8. A missile according to claim 1, in which said missile is adapted to undergo rotational acceleration when launched to stabilize it, and said parachute for said load is a rotary parachute that causes said load to rotate as it falls; and in which said support plate is formed in its plane as a two-part slip coupling, including an outer coupling ring to which said cords of said rotary parachute are attached, and an inner rotary plate that is connected to said lower casing part portion, which is secured to said load.

9. A missile according to claim 8, which includes a means for securing said outer coupling ring of said slip coupling to said upper part of said casing.

10. A missile according to claim 9, in which as said securing means radially projecting retaining lugs are provided on the inside of said upper part of said casing, these retaining lugs securing said outer coupling ring of said sliding coupling both axially and to prevent rotation relative to said upper part of said casing.

11. A missile according to claim 8, which includes a central line that extends from the apex of the parachute canopy of said rotary parachute to said outer coupling ring of said slip coupling.

12. A missile according to claim 11, in which said central line, above said slip coupling, is divided into three individual centering lines, which are symmetrically attached to said outer coupling ring.

13. A missile according to claim 1, which includes a two-step parachute arrangement for setting down said load, including a load-carrying parachute and, provided separately in said casing, a drag parachute, with said casing being secured to a longitudinal line connection thereof.

14. A missile according to claim 13, in which said upper and lower parts of said casing are attached to each other by means of at least one connecting bolt, which can be released by a timer provided on said casing.

15. A missile according to claim 13, in which said upper part of said casing has an intermediate partition for separating said casing into an upper packing chamber for said drag parachute and a lower packing chamber for said load-carrying parachute; and in which at an upwardly open end of said upper part of said casing there are provided closure straps, capable of being torn open, for lashing down said drag parachute packed therein.

16. A missile according to claim 15, in which said upwardly open end of said upper part of said casing is closed off by means of a cover releasably connected thereto, said cover being connected via an activating line to a base of said missile, and to said drag parachute by means of a release line.

17. A missile according to claim 16, in which said activating line is connected to said cover via three centering lines attached thereto, with said cover being provided on its surface with a spiral groove for receiving said activating line and with three radially extending grooves, passing underneath said spiral groove, for receiving said centering lines.

18. A missile according to claim 17, in which said activating line is embedded in said spiral groove and is cast with a plastics composition to hold it in place.

19. A missile according to claim 18, in which said centering lines are placed in said radial grooves, which are disposed in a star-shaped pattern and are attached to an outer circumferential region of said cover.

20. A missile according to claim 19, in which said centering lines form said releasable connection between said cover and said upper part of said casing.

21. A missile according to claim 20, in which disposed on said upper part of said casing is a closure eyelet that has a loop that passes through said cover, with a looped centering line passing transversely through said closure eyelet.

* * * * *